US005276468A

United States Patent [19]

Deur et al.

[11] Patent Number: 5,276,468

[45] Date of Patent: Jan. 4, 1994

[54] METHOD AND APPARATUS FOR PROVIDING PHASE CHANGE INK TO AN INK JET PRINTER

[75] Inventors: Ted E. Deur, Hillsboro; Clark W. Crawford, Wilsonville; Brian J. Wood; Richard Marantz, both of Portland; James D. Buehler, Troutdale, all of Oreg.

[73] Assignee: Tektronix, Inc., Wilsonville, Oreg.

[21] Appl. No.: 965,812

[22] Filed: Oct. 23, 1992

Related U.S. Application Data

[63] Continuation of Ser. No. 674,232, Mar. 25, 1991, abandoned.

[51] Int. Cl.[5] ..... B41J 2/17

[52] U.S. Cl. ..... 346/140 R

[58] Field of Search ..... 346/140, 1.1; 400/126

[56] References Cited

U.S. PATENT DOCUMENTS

| | | | |
|---|---|---|---|
| 4,580,147 | 4/1986 | DeYoung et al. | 346/140 R |
| 4,593,292 | 6/1986 | Lewis | 346/1.1 |
| 4,607,266 | 8/1986 | DeBonte | 346/140 PR |
| 4,609,924 | 9/1986 | DeYoung | 346/1.1 |
| 4,631,557 | 12/1986 | Cooke et al. | 346/140 R |
| 4,658,274 | 4/1987 | DeYoung | 346/140 R |
| 4,667,206 | 5/1987 | DeYoung | 346/1.1 |
| 4,682,187 | 7/1987 | Martner | 346/140 R |
| 4,742,364 | 5/1988 | Milkalsen | 346/140 R |
| 4,814,786 | 3/1989 | Hoisington et al. | 346/1.1 |
| 4,873,539 | 10/1989 | DeYoung | 346/140 R |

*Primary Examiner*—Mark J. Reinhart

*Attorney, Agent, or Firm*—John D. Winkelman; Alan K. Aldous

[57] ABSTRACT

A FRU assembly (10) comprises a melt chamber (20) including multiple subchambers (30) in which sticks of phase change ink (38, 40) are inserted and melted. Melted ink flows through apertures (54) to a reservoir (28) comprising multiple compartments (56). Each compartment contains a channel (90) and a siphon plate (114) that allow a siphon action that siphons melted ink in the compartments to an orifice (100) that leads to an ink jet print head (16). Heaters (52, 82, and 142) under the control of a CPU (154) melt the ink and keep the melted ink at a desired temperature during various modes of operation.

19 Claims, 9 Drawing Sheets

METHOD AND APPARATUS FOR PROVIDING PHASE CHANGE INK TO AN INK JET PRINTER

RELATED APPLICATION

This application is a continuation of U.S. patent application No. 07/674,232 of Ted E. Duer, Clark W. Crawford, Brian J. Wood, and Richard Marantz filed Mar. 25, 1991, now abandoned.

TECHNICAL FIELD

The present invention relates to a method and an apparatus for melting solid sticks of phase change ink and providing the melted ink to an ink jet head.

BACKGROUND OF THE INVENTION

Ink jet printers eject ink onto a print medium, such as paper, in controlled patterns of closely spaced dots. Two commonly used inks are aqueous ink and phase change or hot melt ink. Phase change ink has a liquid phase when it is above the melting temperature, for example 86° C., and a solid phase when it is at or below the melting temperature.

Phase change ink is conveniently stored, transported, and inserted into an ink jet printer assembly in solid phase. However, for phase change ink to be properly ejected from a print head, the ink must be in the liquid phase and relatively hot. Because it typically takes a few minutes for phase change ink to melt after heat has been applied to it, there must be a supply of melted ink having the proper temperature for the print head to eject. There is, therefore, a need for a method and an apparatus for melting and storing phase change ink and providing the ink to a print head at the proper temperature.

SUMMARY OF THE INVENTION

A FRU assembly comprises a melt chamber including multiple subchambers in which sticks of phase change ink are inserted and melted. Melted ink flows through apertures to a reservoir comprising multiple compartments. Each compartment contains a channel and a siphon plate that allow a siphon action that siphons melted ink in the compartments to an orifice that leads to an ink jet print head. Heaters under the control of a CPU melt the ink and keep the melted ink at a desired temperature during various modes of operation.

An object of the present invention is, therefore, to provide a method and an apparatus for melting and storing phase change ink and providing the ink to a print head at the proper temperature.

Another object of the invention is to provide such an apparatus that controllably and automatically regulates the heat applied to the ink.

Additional objects and advantages of the present invention will be apparent from the detailed description of preferred embodiments thereof, which proceeds with reference to the accompanying drawings.

DETAILED DESCRIPTION OF PREFERRED EMBODIMENT

Figure 1:
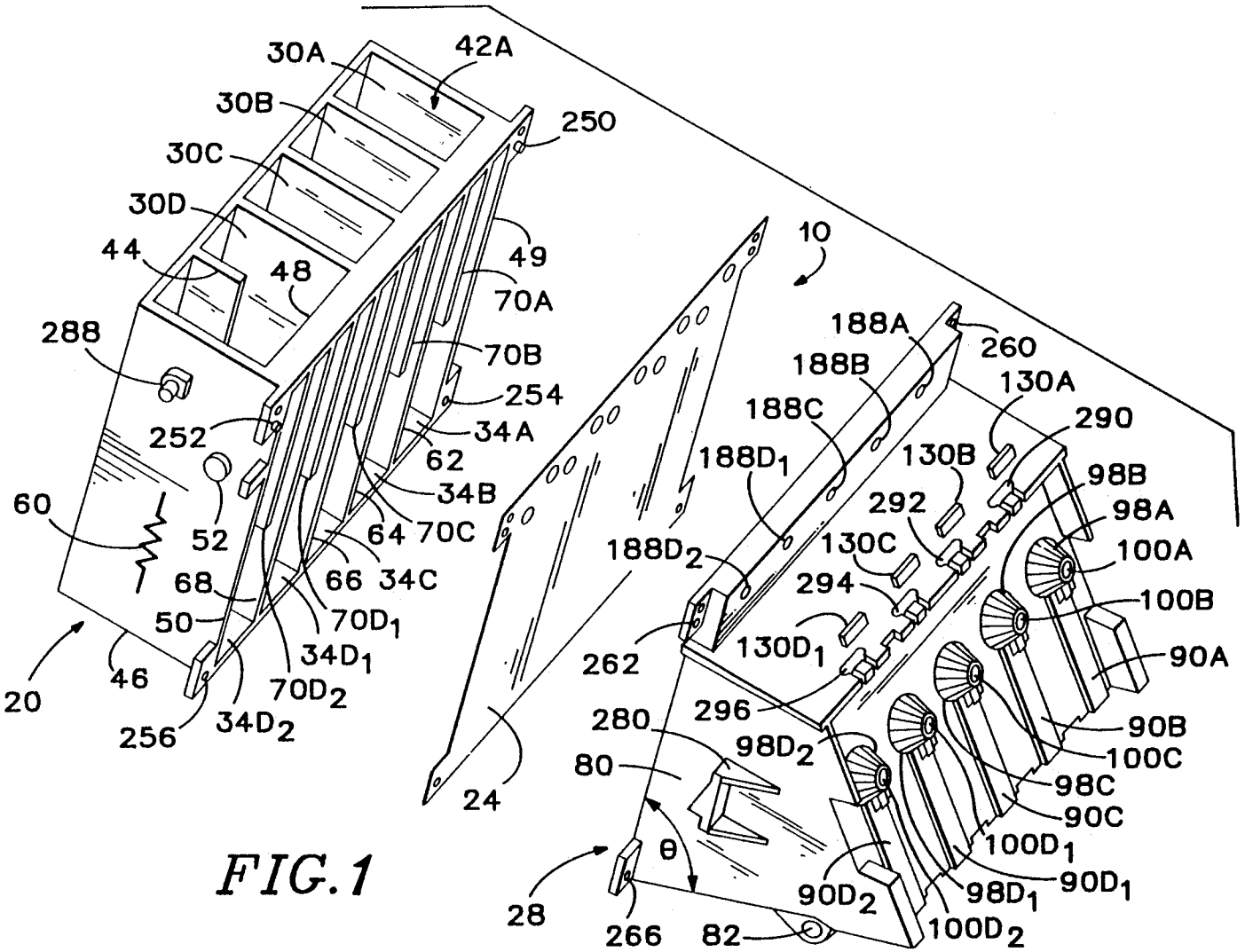
FIG. 1 is an exploded isometric frontal view of an ink melt and reservoir assembly, which is a field replaceable unit ("FRU") in accordance with the present invention.
Figure 2:
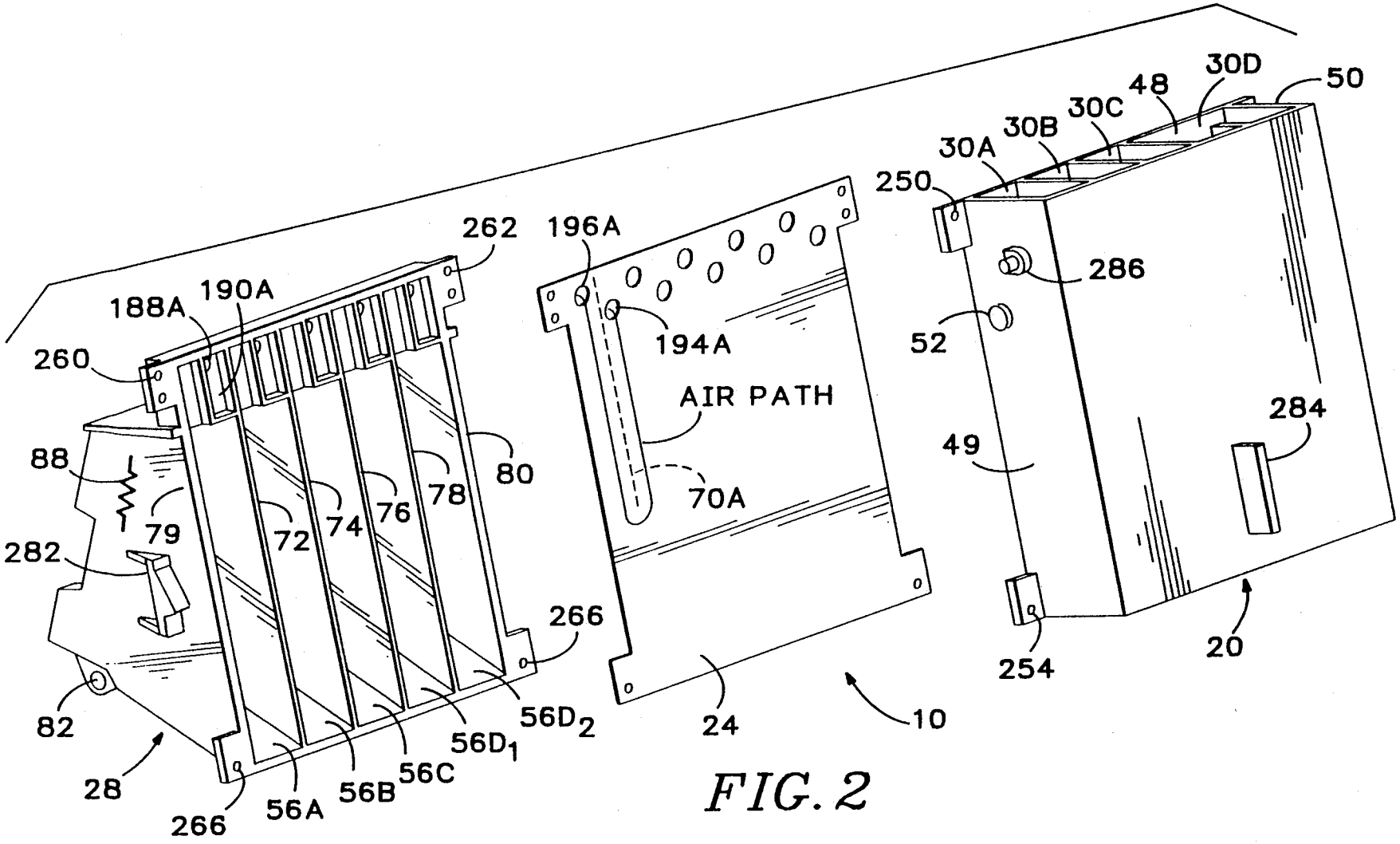
FIG. 2 is an exploded isometric back view of the FRU of FIG. 1.
Figure 3:
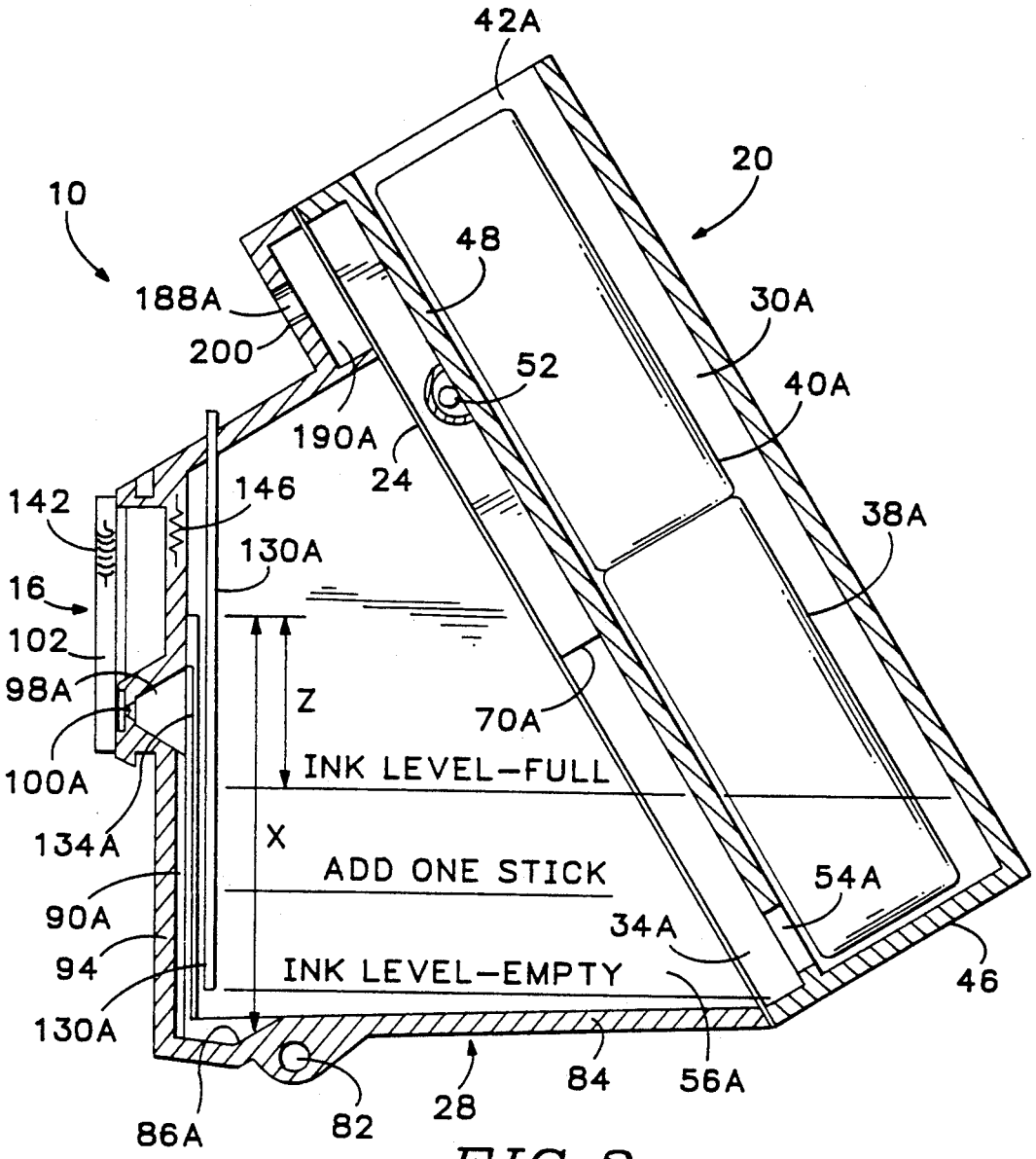
FIG. 3 is a cross sectional side elevation view of the assembled FRU of FIG. 1

Referring to FIGS. 1-3, a field replaceable unit ("FRU") assembly 10 is used by an ink jet printer to receive and melt solid sticks of hot melt ink and provide the melted ink to a multi-orifice ink jet print head assembly 16 ("head 16") affixed to FRU 10. In a preferred embodiment, FRU 10 is constructed to be easily inserted as a unit into an ink jet printer assembly of the type described in U.S. patent application No. 5,083,143 entitled "Rotational Adjustment of an Ink Jet Head" invented by Eldon P. Hoffman, issued Jan. 21, 1992, and assigned to Tektronix, Inc., of Beaverton, Oreg. Heads 16 may or may not be considered part of FRU 10. If there is a defect in a particular FRU 10, then a new FRU 10 may be inserted into the ink jet printer assembly with a minimal amount of downtime. For that reason, FRU 10 is referred to as "field replaceable."

FRU 10 is comprised of a melt chamber 20, a wire cloth mesh filter 24, and a reservoir 28. FRU 10 provides melted ink in multiple colors, for example, cyan, yellow, magenta, and black. The ink of each of these colors is physically separated from the ink of the other colors throughout melt chamber 20 and reservoir 28. Therefore, for convenience in tracing the travel of the ink, the letter "A" is associated with cyan ink, "B" is associated with yellow ink, "C" is associated with magenta ink, and "D" is associated with black ink. FIG. 3 shows only the portions of FRU 10 that are used in connection with cyan ink.

Melt chamber 20 is divided into subchambers 30A, 30B, 30C, and 30D (collectively "subchambers 30"), and air chambers 34A, 34B, 34C, 34D$_1$, and 34D$_2$ (collectively "air chambers 34"), as described below with reference to FIG. 3. Subchamber 30D, which is divided by divider 44, holds twice as many sticks as the other subchambers because black ink is typically used more frequently than the other colors.

Referring to FIG. 3, sticks 38A and 40A of cyan ink are placed through an opening 42A in the top of subchamber 30A. Ink stick 38A rests against a floor 46 and a melt plate 48, the latter of which subdivides subchambers 30 from air chambers 34. Stick 40A rests against stick 38A and plate 48. Ink sticks 38B and 38C (not shown) rest against floor 46 and plate 48 in subchambers 30B and 30C, respectively. Ink sticks 40B and 40C (not shown) rest against sticks 38B and 38C and plate 48. Ink sticks $38D_1$ and $38D_2$ (not shown), rest against floor 46 and plate 48 in subchamber 30D. Ink sticks $40D_1$ and $40D_2$ rests against sticks $38D_1$ and $38D_2$ and plate 48. Melt chamber 20 is bounded by side walls 49 and 50.

Melt chamber 20 is preferably formed of a single piece of magnesium, which is light weight and heat conductive. Melt chamber 20 is heated by a resistive-type heater element 52 that causes sticks 38A-$38D_2$ and 40A-$40D_2$ to melt. In a preferred embodiment heater 52 is a standard ¼ inch (6.35 millimeters ("mm")) diameter cartridge heater, such as one manufactured by Watlow. Heater 52 is placed next to plate 48 and across the width of melt chamber 20. The ends of heater 52 are shown on side walls 49 and 50 in FIGS. 1 and 2. A thermistor 60 measures the temperature of the surface of melt chamber 20 at a convenient location, such as the side of melt chamber 20 shown in FIG. 1.

Figure 4A:
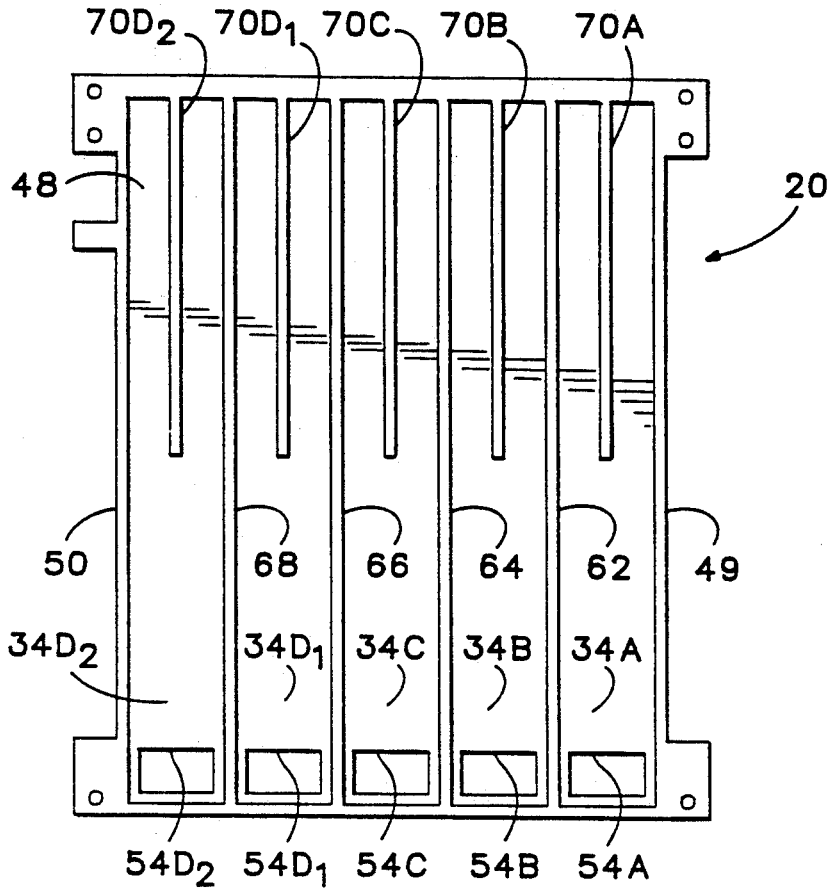
FIG. 4A is a front view of the melt chamber.

Referring to FIGS. 1 and 4A, melted ink flows under the force of gravity from subchambers 30A, 30B, and 30C through apertures 54A, 54B, and 54C to air chambers 34A, 34B, and 34C, respectively. Apertures $54D_1$ and $54D_2$ allow ink to flow from subchamber 30D to air chambers $34D_1$ and $34D_2$. Air chambers 34 are separated by plates 62, 64, 66, and 68. Ribs 70A, 70B, 70C, $70D_1$, and $70D_2$ are used in connection with an air flow system, discussed below.

Figure 4B:
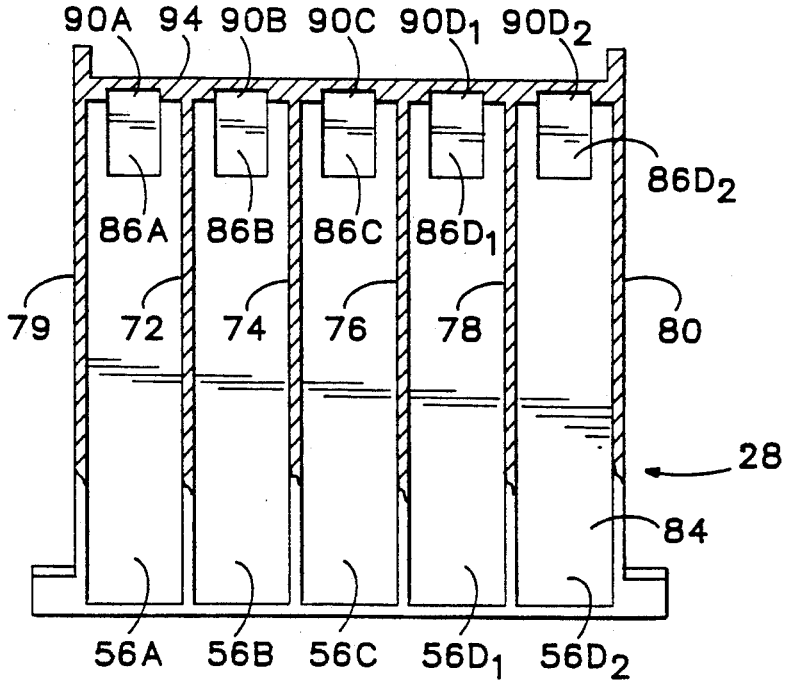
FIG. 4B is a top view of the reservoir.

Referring to FIGS. 2 and 4B, reservoir 28 is divided into compartments 56A, 56B, 56C, $56D_1$, and $56D_2$ by plates 72, 74, 76, and 78. Reservoir 28 is bounded by side walls 79 and 80, as best shown in FIGS. 1 and 2. Referring to FIG. 2 in particular, filter 24 is placed between melt chamber 20 and reservoir 28. Melt chamber 20 and reservoir 28 are tightly joined together with filter 24 positioned between them. The ends of walls 49 and 50 and plates 62, 64, 66, and 68 press tightly against the ends of walls 79 and 80 and plates 72, 74, 76, and 78, respectively. Therefore, ink passes from air chambers 34A, 34B, 34C, $34D_1$, and $34D_2$, through filter 24, to compartments 56A, 56B, 56C, $56D_1$, and $56D_2$, respectively. Ink in any one of the air chambers 34 or compartments 56 does not pass to any of the other air chambers 34 or compartments 56. The exception is that air chambers $56D_1$ and $56D_2$ are joined to melt chamber 30D and there is an opening at the base of wall 68 between compartments $56D_1$ and $56D_2$, so that black ink may flow between compartments $56D_1$ and $56D_2$.

The appropriate pitch for filter 24 depends on the diameter of the nozzles in head 16 and size of particulates in the melted ink. If the melted ink contains a substantial amount of particulates that cannot pass through filter 24, then it will become clogged and thereby rapidly lead to poor performance and increased cost for replacement. On the other hand, if the pitch of filter 24 is not small in comparison to the diameter of the nozzles in head 16, then the nozzles in head 16 will become clogged relatively fast. It is preferred that head 16 be made of stainless steel. In a preferred embodiment, filter 24 comprises a Dutch twill woven wire cloth mesh with a 165×1400 lay and a pitch of 17 microns. An example of phase change ink usable with the embodiment described herein is found in U.S. Pat. No. 4,889,560 of Jaeger, et al., entitled "Phase Change Ink Composition and Phase Change Ink Produced Therefrom," which is assigned to Tektronix, Inc., of Beaverton, Oreg.

Ink in reservoir 28 is heated primarily by a resistive-type heater element 82, which is coupled to floor 84 of reservoir 28, and secondarily by heat from melt chamber 20. In a preferred embodiment, heater 82 is a cartridge heater of the same type as heater 52 and is placed in a hole beneath floor 84 that runs across the entire width of reservoir 40 so that heater 82 is beneath a section of each compartment 56. The ends of heater 82 are shown on each side of reservoir 28 in FIGS. 1 and 2. A thermistor 88 measures the temperature of reservoir 28 at a convenient location, such as the side of reservoir 28 shown in FIG. 2.

Floor 84 is sloped toward sumps 86A (shown in FIGS. 3 and 4B) and sumps 86B, 86C, $86D_1$, and $86D_2$ (shown in FIG. 4B) (collectively "sumps 86"). Channels 90A, 90B, 90C, $90D_1$, and $90D_2$ (collectively "channels 90") are indentations (shown in FIG. 1) in front plate 94 of reservoir 28 in compartments 56A, 56B, 56C, $56D_1$, and $56D_2$, respectively. Channels 90 are shown as indentations that extend out of front plate 94 for convenience of illustration. It may, however, be easier to manufacture the indentations of channels 90 inside front plate 94, as shown in FIG. 4B, rather than as extensions on front plate as shown in FIG. 1. Channels 90A, 90B, 90C, $90D_1$, and $90D_2$ extend from sumps 86A, 86B, 86C, $86D_1$, and $86D_2$ to chambers 98A, 98B, 98C, $98D_1$, and $98D_2$ (collectively "chambers 98"), respectively. Ink exits chambers 98A, 98B, 98C, $98D_1$, and $98D_2$ through orifices 100A, 100B, 100C, $100D_1$, and $100D_2$ (collectively "orifices 100"), respectively, toward head 16. Optional filters 134A, 134B, 134C, $134D_1$, and $134D_2$, similar to filter 24 may be placed in or next to chambers 98A, 98B, 98C, $98D_1$, and $98D_2$.

Figure 5:
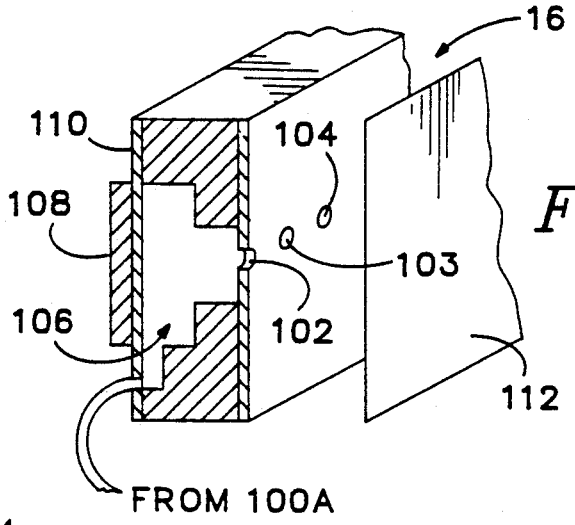
FIG. 5 is a schematic fragmentary view of a representative ink jet head.

FIG. 5 shows a schematic view of nozzles 102, 103, and 104 of head 16, which is representative of a typical ink jet head. Ink from orifice 100A enters ink chamber 106. Other nozzles (not shown) receive ink from orifices 100. A piezoceramic material 108 is bonded to a diaphragm 110. An electrical current is applied to piezoceramic material 108. When the current has a particular amplitude and polarity, piezoceramic material 108 bends toward chamber 106 causing ink to be ejected from nozzle 102 toward a print medium 112. A low thermal mass of head 16, and the thermal isolation between head 16 and reservoir 28 allow a more uniform heating of head 16.

Figure 6A:
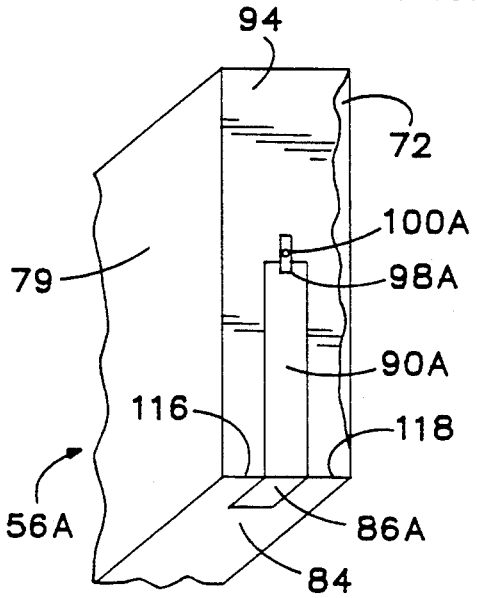
FIGS. 6A, 6B, and 6C show the siphon chamber, siphon plate, and level sensing probe that reside in the reservoir compartments.

Channels 90 span only part of the combined widths of compartments 56. For example, FIG. 6A shows channel 90A in compartment 56A. Front plate 94 joins with floor 84 on both sides of channel 90A at sections 116 and 118. Although orifices 100 appear to be cylindrically-shaped in FIG. 1, they may be right parallelepiped shaped, as shown in FIG. 3. The outer cylindrical-shape can be formed by the manufacturing process.

Figure 6B:
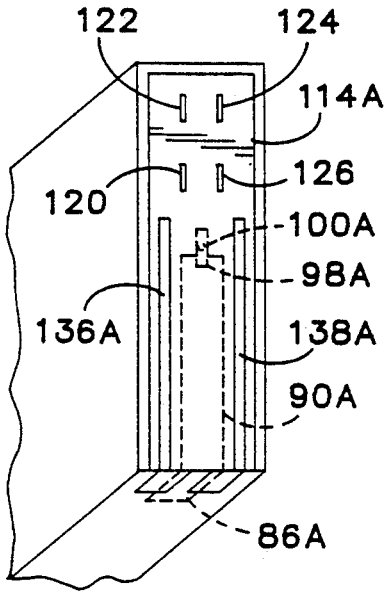

Siphon plates 114A, 114B, 114C, $114D_1$, and $114D_2$ (collectively "siphon plates 114") are positioned adjacent to channels 90A, 90B, 90C, $90D_1$, and $90D_2$, respectively. FIG. 6B shows plate 114A over plate 94, and channel 90A and sump 86A (shown in dashed lines). Ink is siphoned from sumps 86A, 86B, 86C, $86D_1$, and $86D_2$ through channels 90A, 90B, 90C, $90D_1$, and $90D_2$, respectively, to chambers 98A, 98B, 98C, $98D_1$, and $98D_2$, respectively.

Figure 7A:
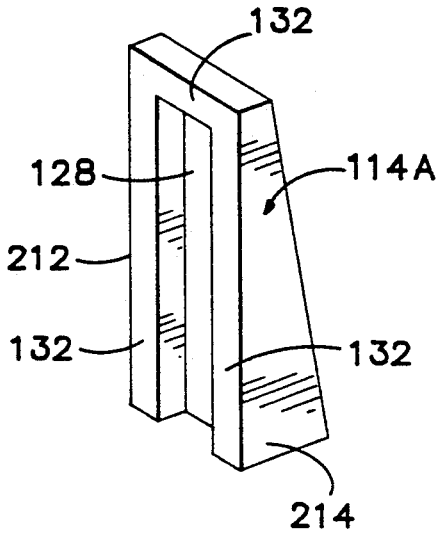
FIGS. 7A and 7B show the siphon plate located in the reservoir.
Figure 7B:
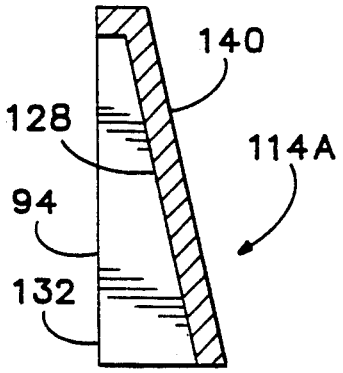

The siphon action is created by a difference in pressure between chamber 106 and channel 90A following an ejection of ink from nozzle 102 in head 16. If siphon plates 114 are positioned too close to front plate 94, there will be capillary action, which may be undesirable because it can lead to ink drooling out of nozzle 102. A preferred embodiment of siphon plates 114 is illustrated by siphon plate 114A, shown in FIGS. 7A and 7B.

Siphon plate 114A is comprised of legs 212 and 214, an inside plate 128, and an outer layer 140. Inside plate 128 is inset about 0.130 inch (3.30 mm) from surface 132 which is sealed to front plate 94. Inside plate 128 and outer layer 140 slope outwardly at a 4° angle with respect to inside plate 128 and surface 132.

Referring to FIG. 3, drooling of ink may also be caused if the surface of the ink in compartment 56A is too close to the height of nozzle 102. The distance from nozzle 102 to the bottom of sump 86A is denominated "X." The distance from nozzle 102 to the full level is denominated "Y." In a preferred embodiment, X=2.1 inches (53.3 mm) and Y=1.0 inches (25.4 mm). If Y is less than zero (i.e., the level of the surface of the ink is higher than nozzle 102), there will probably be drooling of ink from nozzle 102. In addition, if Y is much less than 1.0 inches (25.4 mm), there also may be drooling or other undesirable effects.

FIGS. 3, 6B–6C, and 10B, show the position of siphon plate 114A. In FIG. 6B, the positions of sump 86A, channel 90A, and chamber 98A are shown in dashed lines. Abutments 120, 122, 124, and 126 are used to connect a level sensing probe 130A, shown in FIG. 6C, to siphon plate 114A. Brackets 136 and 138 are used to restrict the movement of ink around level sensing probe 130A to increase the accuracy of the level readings.

Level sensing probes 130A, 130B, 130C, which are attached to siphon plates 114A, 114B, and 114C, respectively, sense the level of ink within compartments 56A, 56B, and 56C, respectively. Level sensing probe 130D, which is attached to siphon plate 114D$_1$, senses the level of ink within compartments 56D$_1$ and 56D$_2$. Ink may pass between compartments 56D$_1$ and 56D$_2$ through an opening at the base of wall 68, so that level sensing probe 130D measures the level of ink in both compartments. The tops of level sensing probes 130A, 130B, 130C, and 130D$_1$ (collectively "level sensing probes 130") are shown in FIG. 1.

Figure 8:
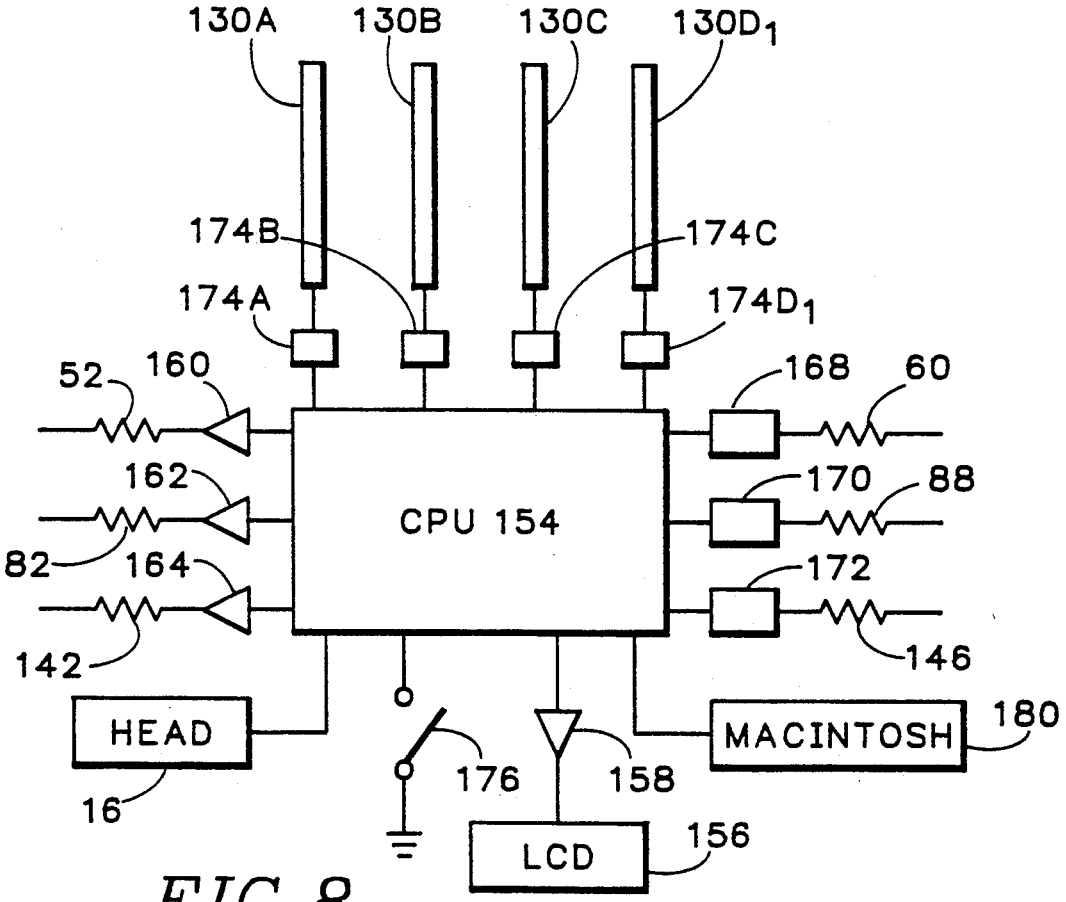
FIG. 8 is a schematic diagram of the central processing unit used in controlling the FRU.

Referring to FIG. 8, level sensing probes 130 signal a central processing unit ("CPU") 154 or other electronics of the ink jet printer assembly to indicate certain information at a human interface unit, e.g., a liquid crystal display ("LCD") 156 or light emitting diodes (not shown). The information includes: (a) whether compartment 56A, 56B, 56C, or 56D$_1$ is empty (i.e., too low to print and too low for the initiation of a purging cycle), and (b) whether the ink level in compartments 56A, 56B, 56B, or 56D$_1$ is such that one stick of ink should be added to subchamber 30A, 30B, 30C, or 30D.

A resistive-type heater 142, shown schematically as a resistor, is used to maintain the temperature of head 16, and thus of the temperature the ink within head 16. Heater 142 may be a cartridge heater of the same type as heaters 52 and 82. One heater 142 is usually sufficient, although multiple heaters could be used. A thermistor 146, attached to head 16, is used to measure the temperature of head 16.

Figure 9:
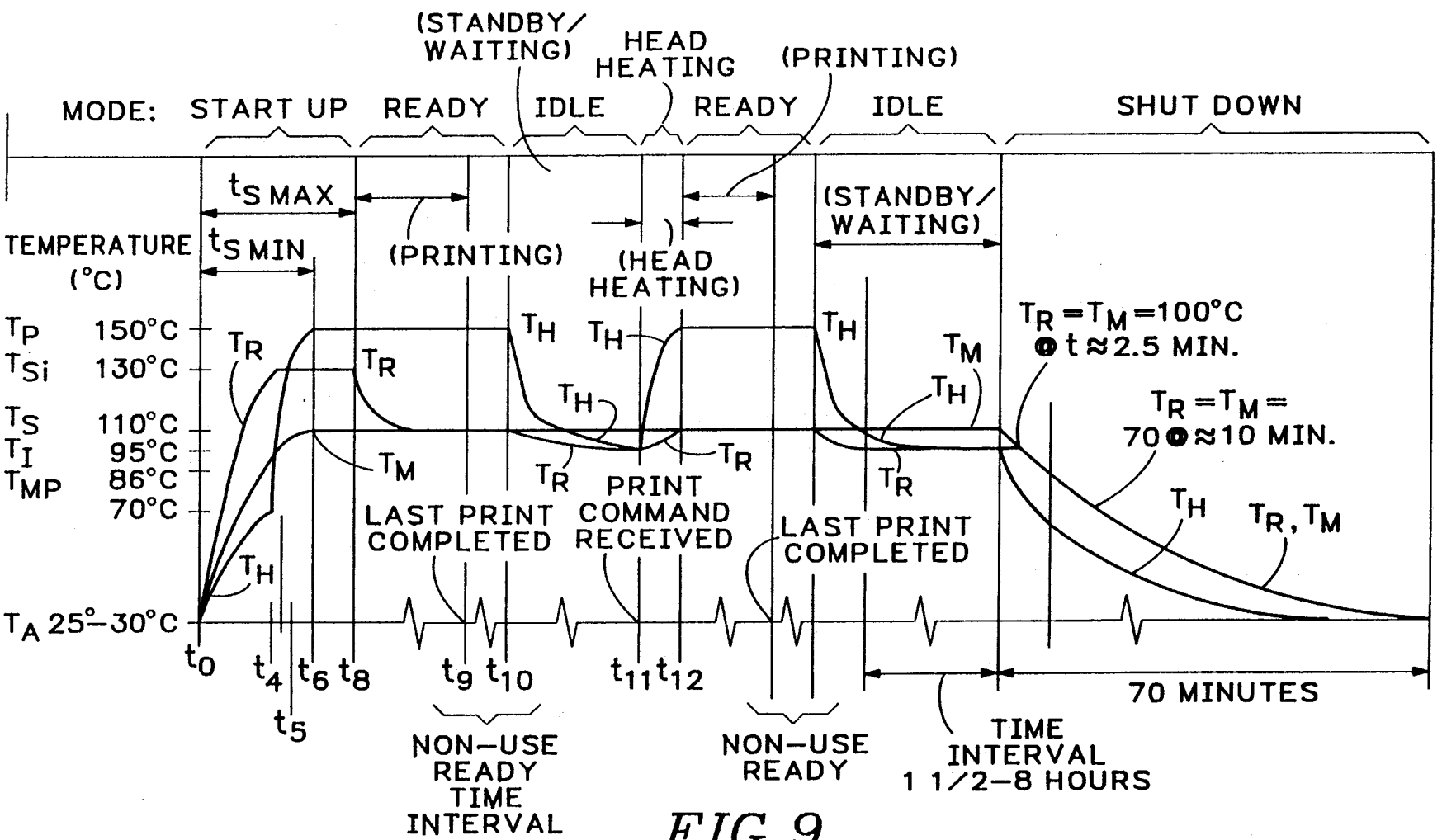
FIG. 9 is graph of temperature versus time of various portions of the FRU during different operating modes.

FIG. 9 illustrates the temperature profile of FRU 10. The temperature profile includes the temperatures $T_M$ (of melt chamber 20), $T_R$ (of reservoir 28), and $T_H$ (of head 16) as a function of time (in minutes) during various modes of operation. Temperatures $T_M$, $T_R$, and $T_H$ are measured by the respective thermistors 60, 88, and 146. Symbols used in FIG. 6 are defined as follows: is the temperature of melt chamber 20;

$T_M$ is the temperature of melt chamber 20;

$T_R$ is the temperature of reservoir 28;

$T_H$ is the temperature of head 16;

$T_P$ is the value of $T_H$ during printing;

$T_{Si}$ is an initial maximum temperature of $T_R$ during the start-up mode;

$T_S$ is the ink supply temperature, i.e., the temperature $T_M$ from time $t_6$ to shut down mode;

In a first embodiment, following ready mode, $T_R$ decreases from $T_S$ to temperature $T_I$ and remains at $T_I$ until head heating mode, and $T_H$ decreases from $T_P$ to $T_I$ remains at $T_I$ until head heating mode;

In a second embodiment, $T_R$ decreases from temperature $T_{Si}$ to temperature $T_S$ following start-up mode, and remains equal to temperature $T_S$ until shut down mode, and $T_H$ decreases from $T_P$ to temperature $T_S$ following ready mode, and remains at $T_S$ until head heating mode;

$T_{MP}$ is the temperature at which ink melts;

$T_A$ is the ambient room temperature;

$t_{smin}$ is the minimum expected start-up time; and $t_{smax}$ is the maximum expected start-up time Preferred values are $T_P$=150° C., $T_{Si}$=130° C., $T_S$=110° C., $T_I$=95° C., $T_{MP}$=86° C., and $T_A$=25° to 30° C.

The modes of operation of FRU 10 include start-up, ready, non-use ready, idle (or standby), head heating, and shut down. Ready mode includes a printing submode and a non-use ready submode. The modes of operation are defined in terms of the temperature of thermistors 60, 88, and 146 and activity or inactivity in printing. The temperature is controlled by heaters 52, 82, and 142. Currents $I_{52}$, $I_{82}$, and $I_{142}$ are supplied to heaters 52, 82, and 142, respectively. For simplicity, the values of currents $I_{52}$, $I_{82}$, and $I_{142}$ are each either $I_{52\text{-}ON}$, $I_{82\text{-}ON}$, and $I_{142\text{-}ON}$, respectively, or zero. The heat is regulated by turning heaters 52, 82, and 142 on and off for required amounts of time. Alternatively, currents $I_{52}$, $I_{82}$, and $I_{142}$ may have values other than zero and $I_{52\text{-}ON}$, $I_{82\text{-}ON}$, and $I_{142\text{-}ON}$.

FIG. 8 shows CPU 154, which is interfaced to heaters 52, 82, and 142, thermistors 60, 88, and 146, level sensing probes 130A, 130B, 130C, and 130D$_1$, on-off switch 176, a MacIntosh computer 180 (manufactured by Apple Computer Co. of Cupertino, Calif.), the piezoceramic material of head 16, and LCD 156. Heaters 52, 82, and 142 are driven under the control of drivers 160, 162, and 164, respectively. The temperatures around thermistors 60, 88, and 146 are measured by thermistor temperature sensors, 168, 170, and 172, respectively. CPU 154 receives print commands from MacIntosh 180 (or another device that can issue print commands). LCD 156 is controlled by CPU 154 through LCD driver 158. LCD 156 displays the information described above and other information such as the ink jet printer is out of paper or malfunctioning.

As used herein with respect to FIG. 9, time $t_4$= time $t_0$+about four minutes; time $t_5$=time $t_0$+about five minutes; time $t_6$=time $t_0$+about six minutes, and time $t_8$=time $t_0$+about eight minutes. However, times $t_9$, $t_{10}$, $t_{11}$, and $t_{12}$ do not occur a specific number of minutes after time $t_0$.

Referring to FIG. 9, at time $t_0$, a user activates on-off switch 176 and start-up mode begins. At time $t_0$, $T_H$=$T_R$=$T_M$=$T_A$ (room temperature), which typically ranges between 25°–30° C., for example, 27° C. Ink in melt chamber 20, reservoir 28, and head assembly 16 are in the solid phase. Shortly after time $t_0$, CPU 154 activates heaters 52 and 82. The temperature $T_M$ of plate 48 is primarily controlled by heater 52. From time $t_0$ to time $t_6$, $T_M$ increases from $T_A$ to $T_S$, as shown in FIG. 9, which causes some ink to melt and flow through apertures 54. CPU 154 keeps $T_M$ at about 110° C. until, shut down mode by turning heater 52 on and off as needed. CPU 154 uses the temperature from thermistor 60 to determine when heater 52 should be turned on and off. Alternatively, from time $t_0$ to time $t_8$, CPU 154 may direct heater 52 to raise $T_M$ to follow the same heat curve as $T_R$, discussed below and shown in FIG. 9.

At time $t_0$, heater 82 is turned on. From time $t_0$ to time $t_4$, $T_R$ increases from $T_A$ to $T_{Si}$. From time $t_4$ to the end of start-up mode at time $t_8$, CPU 154 uses the temperature of thermistor 88 to determine when to turn heater 82 on and off to keep $T_R$ equal to about $T_{Si}$. Following start-up mode, $T_R$ decreases to $T_S$ during ready mode. In the first embodiment, $T_R$ remains at $T_S$ until the end of ready mode, at which time $T_R$ decreases to $T_I$. During head heating mode, $T_R$ increases back to $T_S$ and stays at $T_S$ until the end of ready mode. In the second embodiment, $T_R$ remains at $T_S$ from the first occurrence of ready mode until shut-down mode. The purpose of initially raising the temperature of the ink in reservoir 28 to $T_{Si}$ is to accelerate the melting of ink that may have solidified in reservoir 28. A reason to lower $T_R$ to $T_S$ or $T_I$ during ready, idle, and head heating modes is to reduce the probability of ink degradation caused by excessive heat over a prolonged period of time.

From time $t_0$ to about time $t_4$, ink in head 16 is heated by heat from reservoir 28 and $T_H$ increases from $t_A$ to about 70° C. At time $t_4$, CPU 154 turns on heater 142. From time $t_4$ to about time $t_6$, the temperature $T_H$ of head 16 is raised until it reaches $T_P$. By raising $T_H$ in several steps, priming of head 16 tends to be maintained because the melted ink in reservoir 28 tends to expand into head 16 before the solidified ink in head 16 melts. If head 16 were heated at a faster rate from time $t_0$ to about time $t_4$, ink in head 16 would tend to be forced out of nozzles such as nozzle 102, which could result in air being drawn into the nozzles and cause problems in printing.

The expected first time ("time $t_{actual}$") at which $T_M=T_S$, $T_R=T_{Si}$, and $T_H=T_P$, varies between time $t_{smin}$ (e.g. six minutes) and $t_{smax}$ (e.g. eight minutes) depending on ambient temperature $T_A$ and the type of ink. In FIG. 6, $t_{actual}=t_{smin}$. At time $t_{actual}$, CPU 154 switches from start-up mode to ready mode. (Although in FIG. 9, this does not happen until time $t_{smax}$ for illustrative purposes.) A print command is given from MacIntosh 180 prior to or immediately following time $t_{actual}$. Therefore, CPU 154 causes head 16 to begin printing at the beginning of the ready mode. Alternatively, the first print command could be given after the beginning of ready mode.

During the printing mode of operation, CPU 154 uses the temperature of thermistor 146 to maintain $T_H T_P$ so that the ink has the desired viscosity for printing. During non-use ready mode, $T_H$ remains equal to $T_P$. However, ink is subject to thermal degradation from excessive heat over a period of time. Therefore, following a certain period of non-use ready from $t_9$ to $t_{10}$, ready mode is concluded and $T_H$ is reduced to $T_S$ in the first embodiment and to $T_I$ in the second embodiment. The length of time of non-use ready is arbitrary, but is preferably less than a few hours, and perhaps as short as 30 minutes.

At time $t_9$ (note that time $t_9$ is not equal to $t_0$+nine minutes), printing is concluded, and CPU 154 switches to non-use ready mode. Following a period of non-use ready, the printer is placed in an idle or stand-by mode at time $t_{10}$. At time $t_{11}$, a print command is received by CPU 154, and it switches from idle mode to head heating mode, during which $T_H$ is increased from $T_I$ or $T_S$ to $T_P$. $T_R$ increases to or remains at $T_S$.

During shut-down of the apparatus, the temperatures $T_M$, $T_R$ and $T_H$ are allowed to drop as shown in FIG. 9. The temperature $T_H$ drops somewhat faster than the temperature $T_R$ and $T_M$ so that, as ink solidifies in head 16, the liquid ink from reservoir tends to fill head 16 as ink in head 16 contracts during solidification.

Because $T_S$ and $T_I$ are greater than $T_{MP}$, the ink in reservoir 28 is always melted during ready, non-use ready, and idle modes. Consequently, there is no need to wait for remelting of ink in reservoir 28 prior to printing and following a stand-by mode. Because the ink does not solidify, head 16 does not have to be purged after idle mode.

With the above-described temperature profile, not all of the ink in the reservoir needs to be melted before starting ready mode. The heads 16 may be ready to eject ink as soon as a fluid film forms around a block of ink in reservoir 28. Consequently, a warm-up time of six to eight minutes is typically all that is required before printing can start. Depending on the type of ink and dimensions of FRU 10, the time required before printing can start may be shorter than six minutes.

In a preferred embodiment, melt chamber 20 is about 4 inches (101.6 mm) wide (i.e., from 34A to 34$D_2$), 5 inches tall (127.0 mm), and 1 inch deep (25.4 mm). Reservoir 28 is about 4 inches (101.6 mm) wide, 5 inches (127.0 mm) tall, and 3½ inches (88.9 mm) deep at floor 84. Reservoir 28 accommodates about 150 grams of ink. Floor 84 and the section of reservoir 28 that attaches to filter 24 form an angle $\theta$ (shown in FIG. 1), where floor 84 is parallel to the surface of the earth. The angle $\theta$ is preferably in the range $40° \leqq \theta \leqq 90°$, with about 60° being preferred because it is easier to put sticks of ink into melt chamber 20 if it is sloping at about 60°. Filter 24 should be vertically oriented. If the angle $\theta$ were close to 0°, there would be a tendency for filter 24 to clog because a horizontal filter screen tends to become wet with ink, thereby making it more difficult for air to pass through filter 24.

Compartments 56 are much taller than they are wide. Consequently, when FRU 10 is shuttled (reciprocated) across the surface of the ink jet drum during printing, less sloshing of the ink occurs when FRU 10 reverses direction. This is advantageous for at least two reasons: (a) it is easier to sense the actual level of ink in compartments 56; and (b) it reduces dynamic accelerations of the ink during the shuttling operation, which can affect the desired uniform shuttling speed during printing and ink dot placement on the media.

Figure 6C:
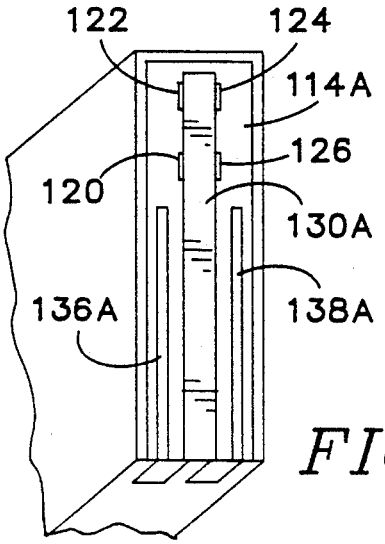
Figure 10A:
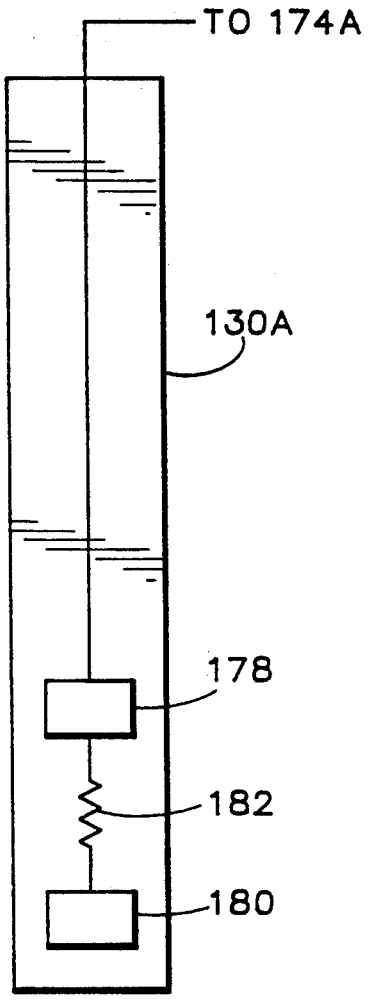
FIG. 10A shows an ink level sensing probe.

Level sensing probe 130A is shown in FIGS. 3, 6C, and 10. Referring to FIG. 10A, level sensing probe 130A is preferrably a conductivity probe with two exposed pads 178 and 180 with a resistor 182 between them. Reservoir 28 acts as ground. Pads 178 and 180 are placed at the one stick and empty levels. Voltage sensors 174A, 174B, 174C, and 174D are connected between CPU 154 and level sensing probes 130A, 130B, 130C, and 130D, respectively. The voltage sensed changes when pads 178 or 180 becomes exposed.

Figure 10B:
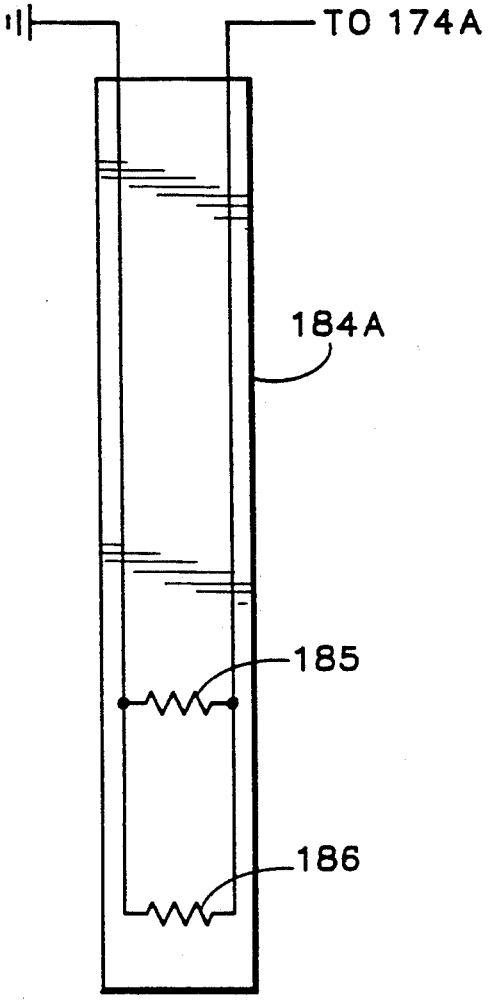
FIG. 10B shows an alternative ink level sensing probe.

Alternatively, referring to FIG. 10B, the level sensing probes could be printed circuit boards such as board 184 having two thermistors 185 and 186, electrically wired together either in parallel (as shown) or in series.

When electrical current is supplied, the heat loss of thermistors 185 and 186 differs from when they are in air to when they are in ink. When the heat loss changes, the resistance of thermistor 185 or 186 changes and is sensed by sensors 174A, 174B, 174C, or 174D$_1$, respectively, which are interfaced between level sensing probes 130A, 130B, 130C, or 130D$_1$, respectively, and CPU 154, as is shown in FIG. 8. As a consequence, level sensing is independent of the temperature of operation of the apparatus. A film of ink can be sensed around the thermistors prior to the time all of the ink in the reservoir is melted. A third thermistor or conductivity pad could be placed in board 184 or probe 130A at the full level to allow CPU 154 to detect overflow.

FRU 10 is preferably operated at atmospheric pressure and, therefore, venting should be provided. As shown in FIG. 2, air traverses a relatively long path in order to trap impurities. Air travels through vent 188A, chamber 190A, and opening 194A to the dirty or upstream side of filter 24. The air travels downwardly around the rib 70A (shown in dashed lines) of melt chamber 34A, shown in FIGS. 1 and 4A. The air then travels through opening 196A of filter 24 and enters the top of compartment 56A. FIG. 3 shows an optional filter 200 over vent 188A.

Figure 11A:
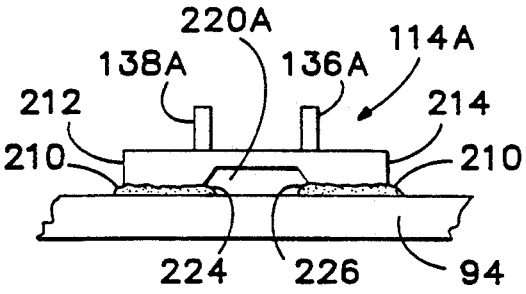
FIGS. 11A, 11B, 11C, and 11D show alternative arrangements of the siphon plate and siphon channel.

FIGS. 11A–11D show different approaches for connecting siphon plate 114 to front plate 94. In FIG. 11A there is no channel 90A. The siphon plate 114A, shown in cross-section, includes legs 212 and 214, which are separated by recess 220A having a generally trapezoidal shape. Recess 220A forms the siphon channel. To secure plate 114A in place, the front surface of legs 212 and 214 is dipped in glue 210 with care being taken to prevent the glue from rising significantly into recess 220A. Menisci 224 and 226 of glue 210 protrude into recess 220A, and may significantly affect the siphon channel of recess 220A. It is noted that the dimensions of FIG. 11A–11D have been exaggerated for purposes of illustration.

Figure 11B:
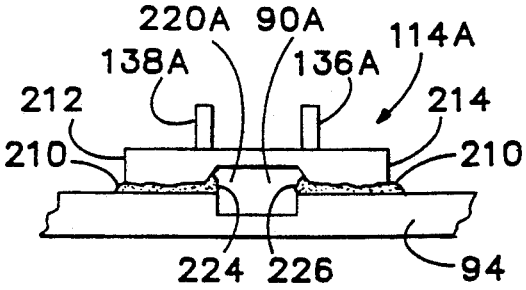
Figure 11C:
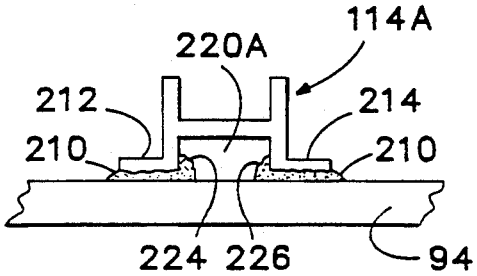
Figure 11D:
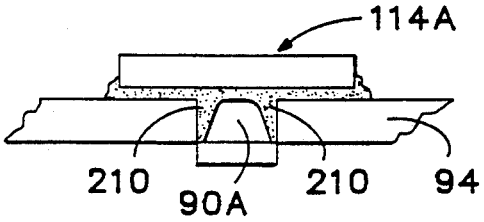

FIG. 11B shows a preferred arrangement, in which the siphon channel includes both recess 220A and channel 90A. Menisci 224 and 226 of glue 210 protrude into recess 220A, but do not significantly block siphon channel 90A and recess 220A. FIG. 11C illustrates a construction that is similar to that shown in FIG. 11A, except that recess 220A is of rectangular rather than trapezoidal shape. Menisci 224 and 226 of glue 210 protrude into recess 220A and may significantly affect the siphon channel of recess 220A. In FIG. 11D, siphon plate 114 is flat, and the siphon path consists of channel 90A. Under the construction of FIG. 11D, glue 210 tends to run into and significantly fill channel 90A.

Figure 12A:
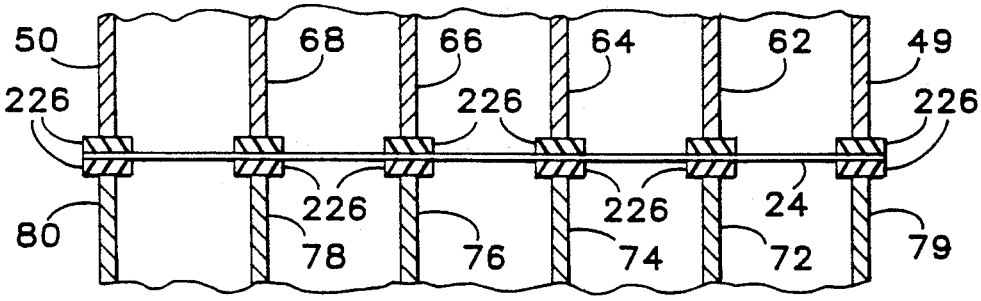
FIGS. 12A and 12B are cross-sectional fragmentary views showing arrangements for sealing a filter with the melt chamber and reservoir.
Figure 12B:
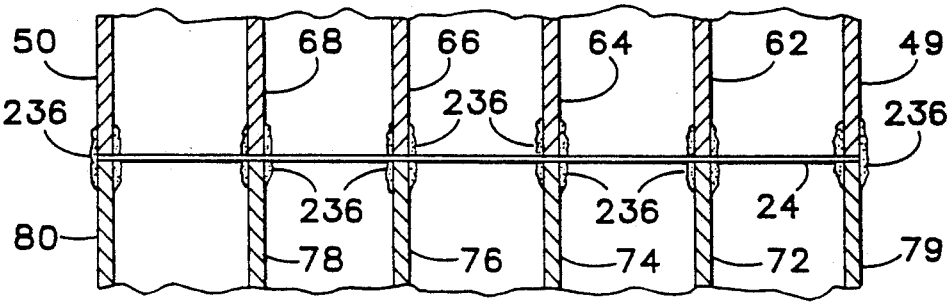

FIGS. 12A and 12B show filter 24 placed between melt chamber 20 and reservoir 28. To prevent ink from weeping between melt chamber 20 and reservoir 28, the ends of walls 49 and 50 and plates 62, 64, 66, and 68 are pressed against the ends of walls 79 and 80 and plates 72, 74, 76, and 78, respectively, with filter 24 separating the walls and plates. In FIG. 12A, a rubber seal 226 is molded onto filter 24 to provide a seal between the ends of walls 49 and 50 and plates 62, 64, 66, and 68 and the ends of walls 79 and 80 and plates 72, 74, 76, and 78, respectively. A disadvantage of using a rubber seal is that it tends to flow into the screen as shown at areas 230 and 232, thereby and partly blocking filter 24.

FIG. 12B shows a preferred approach in which beads of a thermoset adhesive 236 are placed on the ends of walls 49, 50, 79, and 80 and plates 62, 64, 66, 68, 72, 74, 76, and 78, where a seal is to be formed. When it is heated for curing purposes, thermoset adhesive 236 wicks or flows through the screen to make a seal in which adhesive 236 passes outwardly only slightly from the edges of walls 49, 50, 79 and 80 and plates 62, 64, 66, 68, 72, 74, 76, and 78. Adhesive 236 may be of the type called Sylgard manufactured by Dow Corning.

Referring to FIGS. 1 and 2, connector pins and receivers 250, 252, 254, 256, 260, 262, 264, and 266 are used to connect melt chamber 20 to reservoir 28. Knobs 280, 282, 284, 286, and 288 are used to connect FRU 10 to the ink jet assembly. Knobs 290, 292, 294, and 296 on reservoir 28 may be used to attach head 16 to reservoir 28.

It will be obvious to those having skill in the art that many changes may be made in the above-described details of the preferred embodiment of the present invention without departing from the underlying principles thereof. The scope of the invention is, therefore, to be interpreted by the following claims.

We claim:

1. An assembly for melting and storing phase change ink and providing the ink to a print head, the assembly having a ready mode during which printing may occur and an idle mode during which printing may not occur, the assembly comprising:

a melt chamber that receives and holds solid phase change ink having a melting temperature;

melt chamber temperature measuring means for measuring a melt chamber temperature and melt chamber heat applying means for applying sufficient heat to the melt chamber to melt the phase change ink and maintain the melt chamber temperature above the melting temperature virtually throughout the ready and idle modes;

a reservoir operationally connected to the melt chamber such that the melted ink in the melt chamber flows to the reservoir, the print head receiving the melted ink from the reservoir;

reservoir temperature measuring means for measuring a reservoir temperature and reservoir heat applying means for applying sufficient heat to the reservoir to maintain the reservoir temperature above the melting temperature virtually throughout the ready and idle modes; and print head temperature measuring means for measuring a print head temperature and print head heat applying means for applying sufficient heat to the print head to maintain the print head temperature at a particular temperature virtually throughout the ready mode, and at a substantially lower temperature but above the melting temperature virtually throughout the idle mode.

2. The assembly of claim 1, further comprising level sensing means for sensing level of the ink in the reservoir, the level sensing means including two conductivity pads separated by a resistor.

3. The assembly of claim 1 further comprising siphon means for siphoning a portion of the melted ink in the reservoir to an orifice which is operationally connected to the print head, and in which the siphon means comprises a channel in a wall of the reservoir and a plate secured over the channel.

4. The assembly of claim 1 in which the temperature of the ink in the reservoir during idle mode is substantially the same as in ready mode.

5. The assembly of claim 1, further comprising an air path between the melt chamber and the reservoir.

6. The assembly of claim 1 further comprising a first filter between the melt chamber and the reservoir.

7. The assembly of claim 6 further comprising a second filter between the reservoir and the print head.

8. The assembly of claim 1 in which the melt chamber, the reservoir, and the print head hold and segregate multiple colors of the ink.

9. The assembly of claim 1 in which the melted ink flows from the melt chamber to the reservoir under the force of gravity.

10. The assembly of claim 1 in which the phase change ink expands when it changes from the solid phase to the liquid phase, and the assembly has a start-up mode during which the reservoir and print head temperatures are controlled by the reservoir and print head heat applying means during the start-up mode to cause the ink in the reservoir to melt before the ink in the print head melts, whereby the print head maintains a prime during the start-up mode.

11. The assembly of claim 1 in which the phase change ink contracts when it changes from the liquid phase to the solid phase, and the assembly has a shut-down mode during which the reservoir and print head temperatures are controlled by the reservoir and print head heat applying means to cause the ink in the print head to freeze before the ink in the reservoir freezes, whereby the print head stays filled with the ink during the shut-down mode.

12. The assembly of claim 3 in which the siphon means has a spacing between the channel and the plate, the spacing being sufficient to prevent capillary action from drawing the ink from the reservoir into the siphon.

13. An assembly for melting and storing phase change ink and providing the ink to a print head, the assembly having a ready mode during which printing may occur and an idle mode during which printing may not occur, the assembly comprising:

a melt chamber that receives and holds solid phase change ink having a melting temperature;

melt chamber temperature measuring means for measuring a melt chamber temperature and melt chamber heat applying means for applying sufficient heat to the melt chamber to melt the phase change ink and maintain the melt chamber temperature above the melting temperature virtually throughout the ready and idle modes;

a reservoir that holds melted ink from the melt chamber, and provides the print head with the melted ink;

reservoir temperature measuring means for measuring a reservoir temperature and reservoir heat applying means for applying sufficient heat to the reservoir to maintain the reservoir temperature above the melting temperature virtually throughout the ready and idle modes; and print head temperature measuring means for measuring a print head temperature and print head heat applying means for applying sufficient heat to the print head to maintain the print head temperature at a particular temperature virtually throughout the ready mode, and at a substantially lower temperature but above the melting temperature virtually throughout the idle mode.

14. The assembly of claim 13 in which the phase change ink expands when it changes from the solid phase to the liquid phase, and the assembly has a start-up mode during which the reservoir and print head temperatures are controlled by the reservoir and print head heat applying means during the star-up mode to cause the ink in the reservoir to melt before the ink in the print head melts, whereby the print head maintains a prime during the start-up mode.

15. The assembly of claim 13 in which the phase change ink contracts when it changes from the liquid phase to the solid phase, and the assembly has a shut-down mode during which the reservoir and print head temperatures are controlled by the reservoir and print head heat applying means to cause the ink in the print head to freeze before the ink in the reservoir freezes, whereby the print head stays filled with the ink during the shut-down mode.

16. The assembly of claim 13 in which the print head temperature is raised significantly above the reservoir temperature during a transition from the idle mode to the ready mode.

17. The assembly of claim 13 in which the melt chamber, reservoir, and print head are integrally connected.

18. The assembly of claim 13 further comprising a first filter between the melt chamber and the reservoir and a second filter between the reservoir and the print head.

19. The assembly of claim 13 in which reservoir heat applying means applies heat to the reservoir such that the reservoir temperature is higher during ready mode than during idle mode.

* * * * *